US005755652A

United States Patent [19]

Gardner

[11] Patent Number: 5,755,652

[45] Date of Patent: May 26, 1998

[54] EXERCISE APPARATUS

[76] Inventor: Peter Edward Gardner, 43 Queens Drive, Thames Ditton, Surrey JT7 OTJ, England

[21] Appl. No.: 750,335

[22] PCT Filed: Jun. 1, 1995

[86] PCT No.: PCT/GB95/01272

§ 371 Date: Nov. 26, 1996

§ 102(e) Date: Nov. 26, 1996

[87] PCT Pub. No.: WO95/32763

PCT Pub. Date: Dec. 7, 1995

[30] Foreign Application Priority Data

Jun. 1, 1994 [GB] United Kingdom ..... 9410958
Sep. 26, 1994 [GB] United Kingdom ..... 9419375

[51] Int. Cl.[6] ..... A63B 22/14

[52] U.S. Cl. ..... 482/146; 482/147; 601/32

[58] Field of Search ..... 482/146, 147, 482/79, 80; 601/27, 28, 29, 30, 31, 32

[56] References Cited

U.S. PATENT DOCUMENTS

| | | | |
|---|---|---|---|
| 2,206,902 | 7/1940 | Kost | 128/25 |
| 2,209,160 | 7/1940 | Greenberg | 128/25 |
| 2,256,001 | 3/1941 | Titus | 601/32 X |
| 2,827,894 | 3/1958 | Meyers | 128/25 |
| 3,461,857 | 8/1969 | Poulin | 128/25 |
| 4,290,601 | 9/1981 | Mittelstadt | 482/146 X |
| 4,905,994 | 3/1990 | Hartz | 482/146 |
| 4,946,160 | 8/1990 | Bertoletti | 482/146 X |

FOREIGN PATENT DOCUMENTS

| | | | |
|---|---|---|---|
| 0961709 | 9/1982 | U.S.S.R. | 482/146 |
| 1290606 | 9/1972 | United Kingdom . | |
| 2195906 | 4/1988 | United Kingdom . | |
| 8703500 | 6/1987 | WIPO . | |

*Primary Examiner*—Richard J. Apley
*Assistant Examiner*—William LaMarca
*Attorney, Agent, or Firm*—Edwin D. Schindler

[57] ABSTRACT

An exercise apparatus including a platform for a user to stand or sit upon, mounted on a body formed of two wedge-shaped parts which are turned relative to each other so that the platform is inclined relative to a base. The platform is coupled to the top of the body via a first bearing, and the body is coupled to the base by a second bearing: the platform is prevented from rotating relative to the base by a gimbal arrangement. A motor coupled to a shaft rotates the body so that the direction of tilt of the platform sweeps around in a corresponding circular manner.

12 Claims, 4 Drawing Sheets

EXERCISE APPARATUS

This invention relates to an exercise apparatus, particularly for exercising the ankles, legs and hips, of the user. The exercise apparatus may be used for rehabilitation purposes, or to increase the fitness of a sportsman, for example.

In everyday life, there are many muscles which receive little or no exercise, particularly muscles around the ankles and muscles around the lower back. A number of different exercise apparatus have been proposed in the past, but the present invention seeks to provide an improved apparatus.

In accordance with this invention, there is provided an exercise apparatus comprising a body having two wedge-shaped parts, the two parts being turned relative to each other so that the opposite ends of the body are inclined to each other, said opposite ends of the body being coupled to end members via respective bearings.

In one embodiment, the two body parts can be turned through a selected angle relative to each other and then secured together: the angle of inclination between the opposite ends of the body will vary according to the relative angle at which the two body parts are engaged together.

The apparatus can be used in a variety of ways. For example, it can be placed on the ground, with one of the two end members forming a base which is laid flat on the ground, and the other end member forming a platform or footplate for the user to stand upon. By appropriately shifting his weight around in a circular movement, the user can cause the direction of tilt of the platform to sweep around in a corresponding circular fashion, at the same time causing the lower body part to turn on its bearing relative to the base. Preferably means are provided for preventing the platform turning relative to the base, but the second bearing allows the upper body part to turn freely relative to the platform. The apparatus may be used for sitting upon, instead of standing upon.

The apparatus preferably includes a drive motor, for driving the body of the apparatus and so causing the direction of tilt of the platform to sweep around in its circle: the apparatus is particularly advantageous in this form, as it does not require any skill on the part of the user.

A third bearing may be provided between the two wedge-shaped body parts, to introduce a random feature into the action of the exerciser.

In another modification, the body may comprise more than two wedge-shaped parts, which can be turned relative to each other.

Embodiments of this invention will now be described by way of examples only and with reference to the accompanying drawings, in which.

Figure 1:
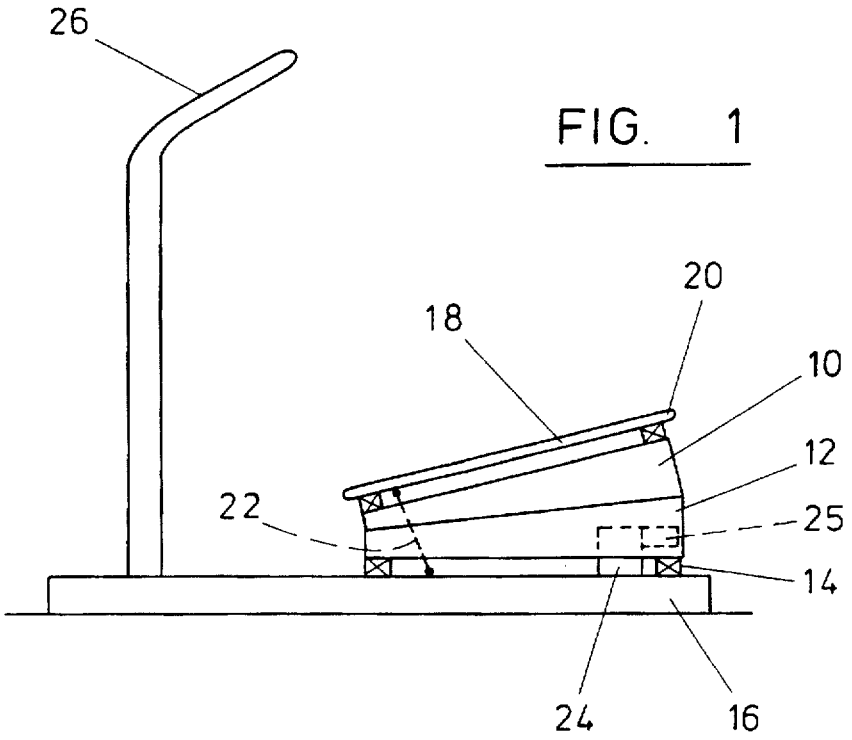
FIG. 1 is a diagrammatic side view of an exercise apparatus in accordance with the invention.
Figure 2:
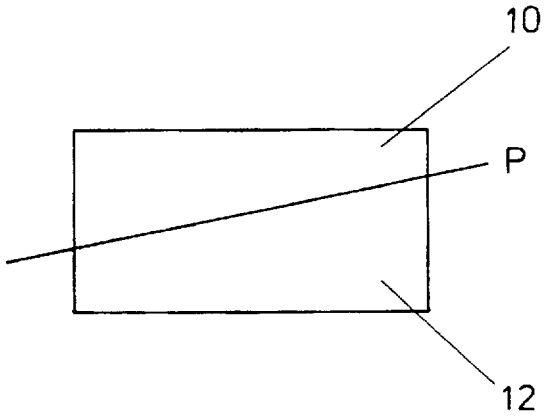
FIG. 2 is a diagram to show how the body parts of the apparatus are formed from a single cylinder.

Referring to FIGS. 1 and 2, there is shown an exercise apparatus which comprises a hollow cylindrical body which has been divided into two parts 10,12 along a plane P which is inclined at an acute angle to the transverse end planes of the body. The two circular, wedge-shaped parts 10,12 can be turned relative to each other, through a selected angle, and then secured together against relative movement: for example, one part 10 may have pins projecting from it at spaced points around its rim, for locating in similarly spaced sockets in the rim of the other part 12. Thus, as seen in FIG. 1, the upper rim of the upper part 10 lies at an inclined angle to the lower rim of the lower part 12: the angle of inclination can be adjusted or selected between a minimum and a maximum, according to the angle through which the two parts 10,12 are turned relative to each other (from the reference position shown in FIG. 2) before being engaged together.

On its lower rim, the lower part 12 carries an annular bearing 14 (e.g. a ball race) by which it is mounted to a base 16, for rotation of the lower part 12 around a vertical axis. On its upper rim, the upper part 10 carries a similar annular bearing 18, by which a circular platform or footplate 20 is mounted. A tie 22 is pivotally secured at its opposite ends to the underside of the platform 20 and to the upperside of the base 16, to prevent the platform 20 rotating relative to the base 16: the tie 22 is shown extending through the hollow centres of the two body parts 10,12 but may instead extend outside these parts.

In the example shown, an electric motor 24 is mounted to the base 16 and arranged, via a gear chain or other suitable transmission indicated at 25, to drive the lower body part 12, so turning this part around its vertical axis. It will be noted that the platform 20 is tilted and will remain tilted, but the angular direction in which it is tilted will sweep around in a circle, as the lower body part 12 is rotated around its axis by the motor: however, the platform 20 is held against rotation relative to the base 16, but the bearing 18 allows the upper body part 10 to turn relative to the platform, as the upper body part 10 turns with the lower body part 10 turns with the lower body part 12.

In use, the person wishing to exercise stands on the platform 20, and switches on the motor 24 via s switch on a support frame 26. As explained above, the platform 20 does not turn, but its direction of tilt sweeps around in a circle. The user may hold onto the support frame 26, generally at waist level: alternatively, the support frame 26 may be absent or remain unused, and the user balances himself; in this way the user improved his agility and balance. In any event, preferably the motor changes direction periodically.

The apparatus need not include the drive motor. In this case, the user can cause the body 10,12 to turn around the vertical axis, and the direction of tilt to sweep around in its circle, by applying a greater proportion of his weight to appropriate radially outer regions of the platform in an appropriate circular sequence. In this case, means may be provided to limit the number of turns which the body makes in each direction, before it must be turned in the opposite direction. Also, preferably frictional or other means are provided to oppose the rotation of the body 10, 12, so that the person exercising works against a resistance.

Figure 3:
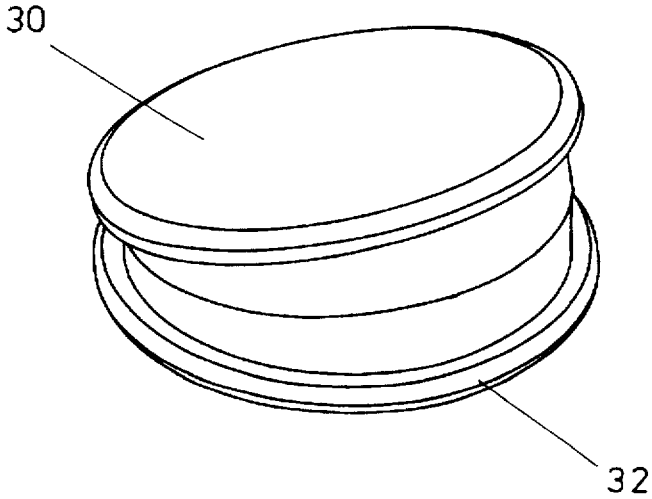
FIG. 3 shows another embodiment of exercise apparatus in accordance with the invention.
Figure 4:
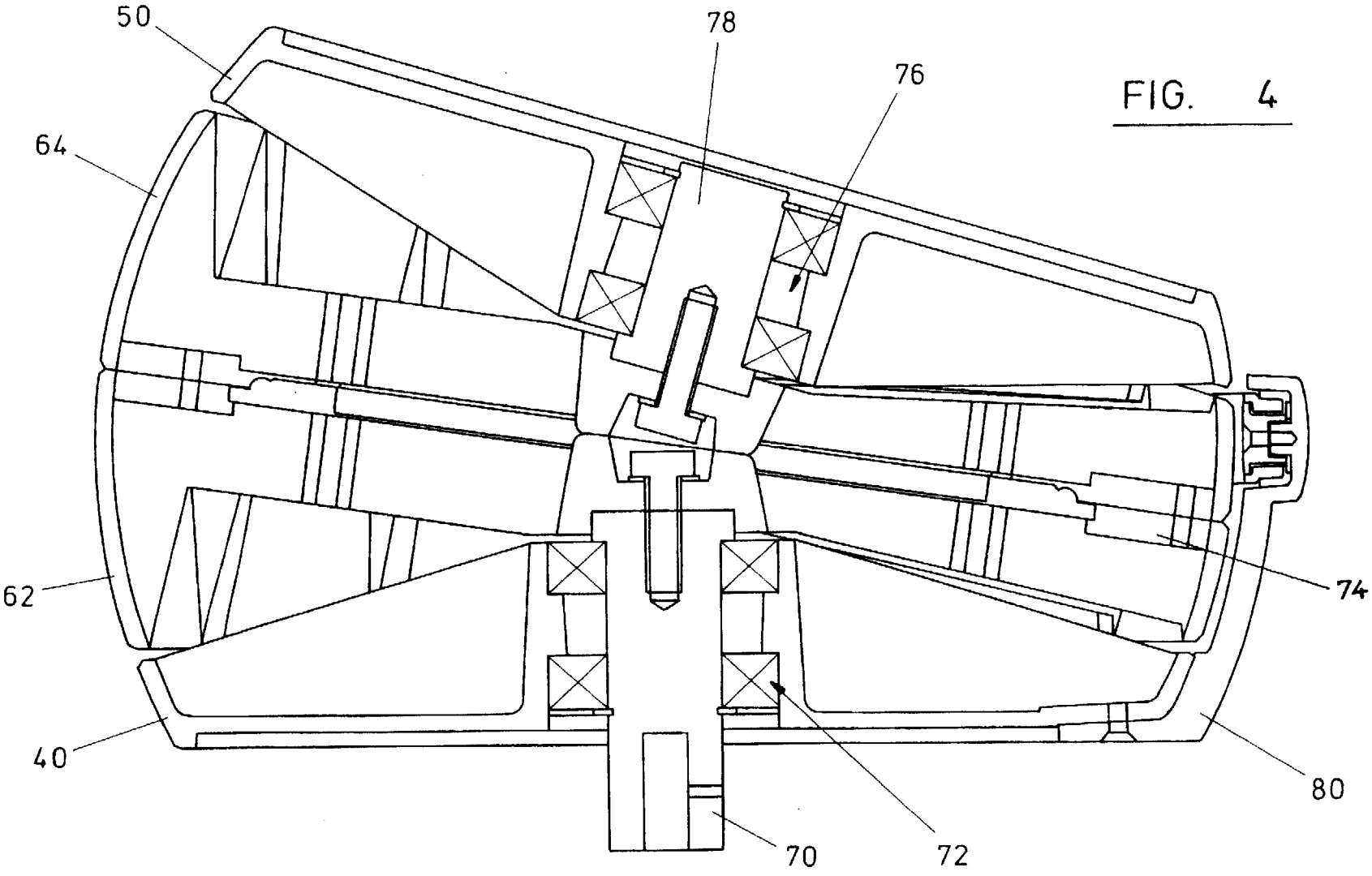
FIG. 4 is a section through a further embodiment of exercise apparatus in accordance with the invention.
Figure 5:
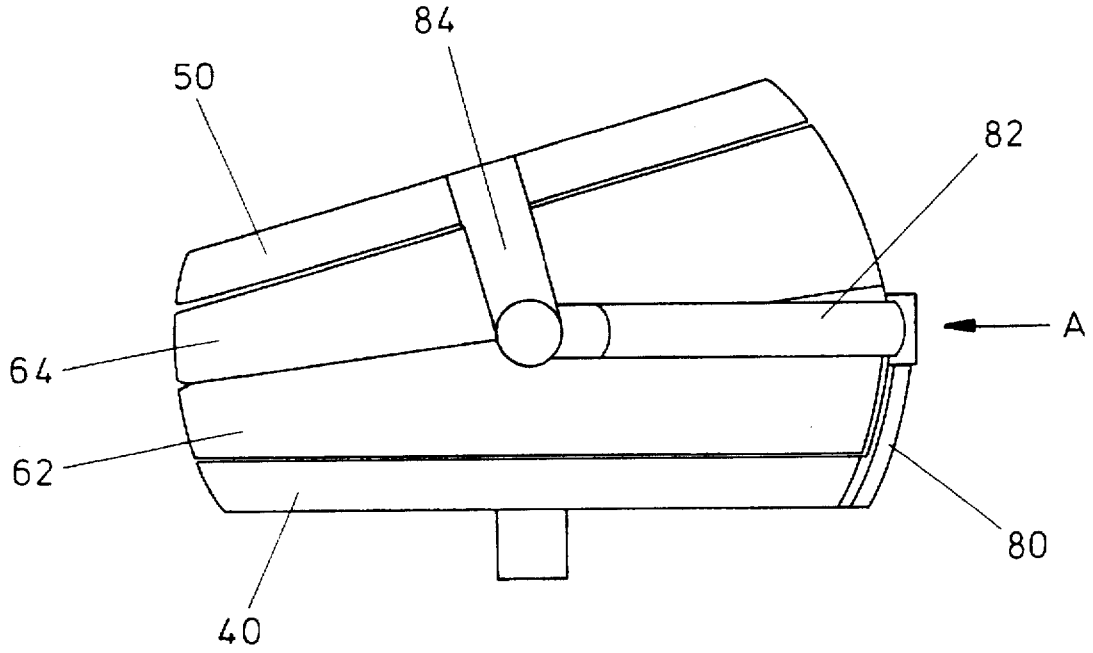
FIG. 5 is a corresponding side elevation of the exercise apparatus of FIG. 4.
Figure 6:
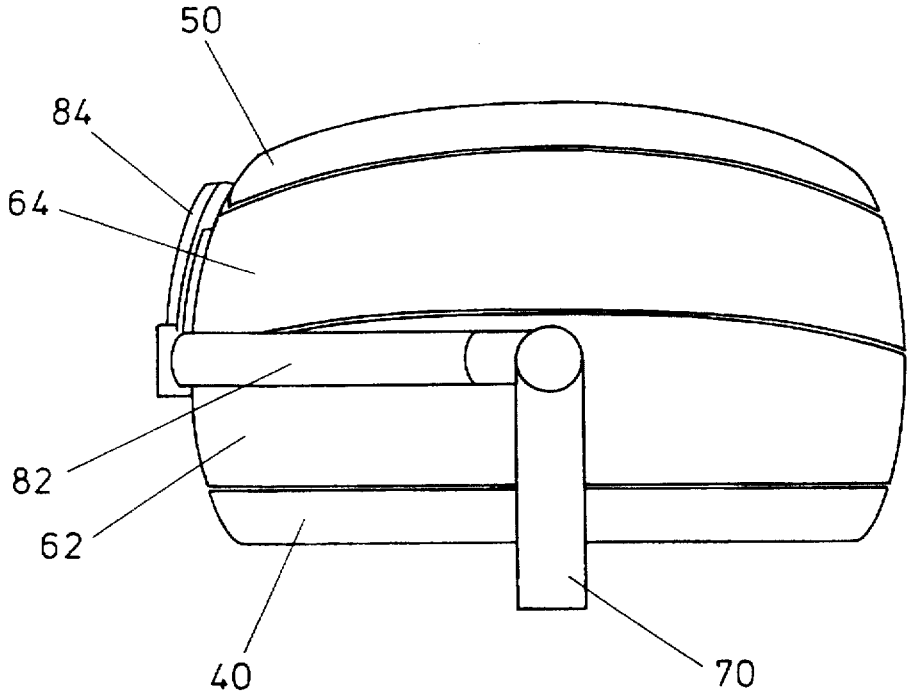
FIG. 6 is a view of the exercise apparatus in the direction of arrow A in FIG. 5.
Figure 7:
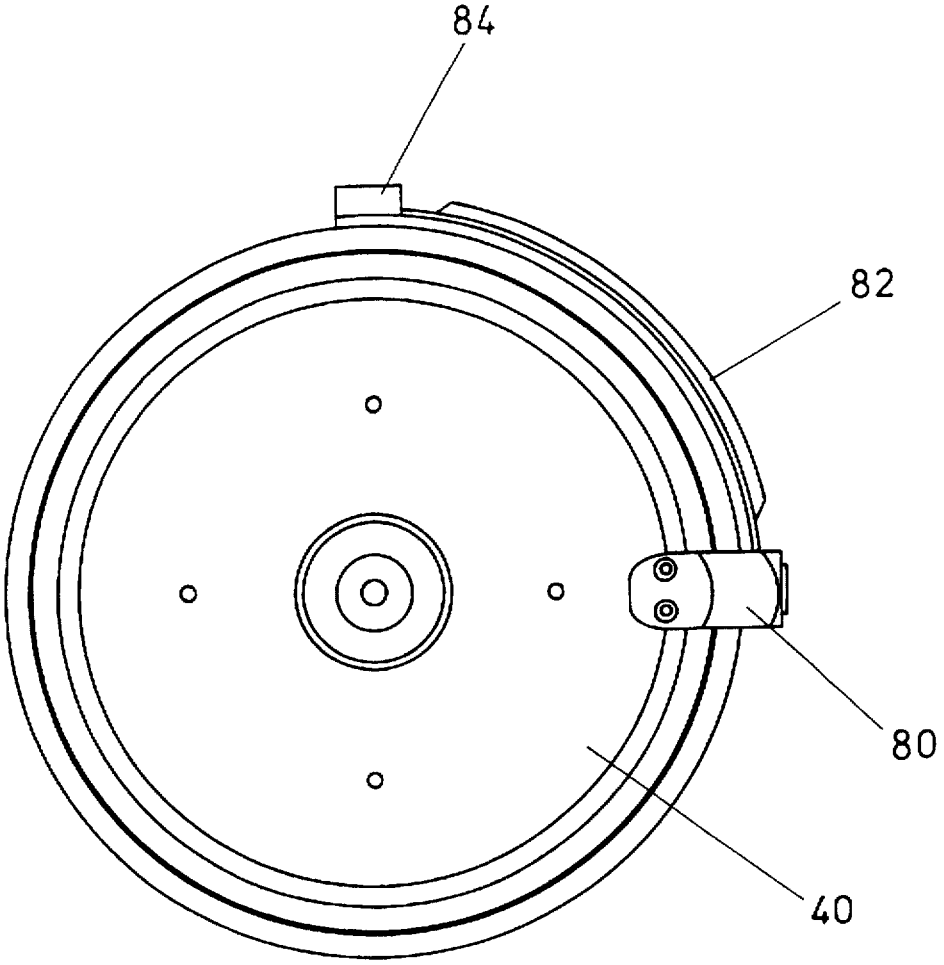
FIG. 7 is a view of the underside of the apparatus of FIGS. 4 to 6.

The apparatus which has been described may be used, with or without the drive motor, for sitting upon, rather than standing upon. The example shown in FIG. 3 has two identical body parts, as in FIGS. 1 and 2, and two identical end plates 30,32 of circular form. The apparatus may be used in a variety of ways, including standing upon or sitting upon, but may also be used for exercising the hands and arms, for example if the exerciser is gripped with the palms of the hands flat against the two end plates 30,32.

Further modifications are applicable to all forms of the apparatus which have been described. For example, the two body parts 10,12 may be mounted together via a third annular bearing, enabling relative rotation between the two body parts, and so introducing a random feature to the action of the apparatus. In another modification, the lower bearing 14 may be positioned with its axis offset from, i.e. eccentric relative to, the axis of lower body part 12. In a further modification, the body may comprise more than two wedge-shaped parts, for example by dividing the cylindrical body of FIG. 2 along two or more inclined planes and therefore into three or more wedge-shaped parts.

The preferred embodiment is shown in FIGS. 4 to 7 and comprises a base 40, a platform 50 and a body which comprises two circular, wedge-shaped parts 62,64. A shaft 70 extends through the centre of the base 40 and is journalled in a bearing 72 mounted internally of the base 40. The lower body part 62 is fixed to the top of the shaft 70. A flat bearing 74 (e.g. a ball race) is positioned between the inclined faces of the wedge-shaped body parts 62,64. A bearing 76 is mounted internally of the platform 50 and a stub shaft 78, which is fixed to the upper body part 64, is journalled in this bearing 76. The base 40 is mounted on an enclosure (not shown) which houses an electric motor for rotating the shaft 70 and therefore the lower body part 62. The upper and lower body parts 62,64 may be allowed to turn freely relative to each other, via the bearing 74. However, preferably means are provided for locking the upper and lower body parts together at any selected relative angle of rotation: for example, the two body parts may be interconnected by a gearing mechanism driven by a stepper motor, which can be energised to turn one body part relative to the other, and then de-energised to secure the two body parts against turning relative to each other. The main drive motor, i.e. the motor driving shaft 70, is preferably arranged to build up speed gradually when switched on, and to slow down gradually when switched off: whilst running, this motor may change direction periodically. Whilst this main drive motor is running, the stepper motor for the two body parts may be energised at intervals, to alter the relative angular positions of the two body parts and hence the angle of inclination of the platform 50.

It will be noted that the platform 50 is prevented from rotating relative to the base 40, by means of a gimbal arrangement which comprises a bracket 80 projecting upwards from the base 40 adjacent the outer surface of the body 62,64, the bracket 80 having a bar 82 pivoted to it and running adjacent the periphery of the body 62,64 for 90°: at its free end, the bar 82 has a bracket 84 pivoted to it, the bracket 84 projecting downwards from the platform 50.

It will be appreciated that the apparatus of FIGS. 4 to 7 can exercise the ankles, knees, hips and back by means of a constant passive movement, using a controlled angle of tilt and a controlled speed of rotation: the change of direction can be used if desired, to increase strength and flexibility. It is a particular advantage that because the platform is fixed against rotation relative to the base and the body is rotated by a drive motor, no skill is required on the part of the user.

I claim:

1. An exercise apparatus comprising, a body having two wedge-shape parts, an intermediate bearing disposed between said two body parts to enable said two body parts to be turned relative to each other during pre-operation adjustment or during operation of said exercise apparatus, or both, so that opposite ends of the body are inclined to each other at a variable angle, two end member to which the opposite ends of the body are coupled via respective end bearings, and means for prevention relative rotation between said end members.

2. An exercise apparatus as claimed in claim 1, further comprising a drive motor for turning one said body part relative to the other during pre-operation adjustment or during operation of said exercise apparatus, or both, via said intermediate bearing.

3. An exercise apparatus as claimed in claim 1, further comprising a drive means for turning one of said body parts on its corresponding end bearing and relative to its corresponding end member.

4. An exercise apparatus as claimed in claim 3, in which said drive means is arranged to change periodically the direction of rotation of said one body part relative to its corresponding end member.

5. An exercise apparatus as claimed in claim 1, in which said end bearings have their rotational axes offset from each other.

6. An exercise apparatus as claimed in claim 1, in which one said end member comprises a base for positioning horizontally and the other said end member forms a platform for a user to stand or sit upon.

7. An exercise apparatus, comprising:

a body having two wedge-shaped parts;

an intermediate bearing disposed between said two body parts to enable said two body parts to be turned relative to each other during pre-operation adjustment or during operation of said exercise apparatus, or both, so that opposite ends of the body are inclined to each other at a variable angle;

two end members to which the opposite ends of the body are coupled via respective end bearings;

means for preventing relative rotation between said end members;

a drive motor for turning one said body part relative to the other said body part during pre-operation adjustment or during operation of said exercise apparatus, or both, via said intermediate bearing; and, means for securing said two body parts against turning relative to each other upon de-energization of said drive motor.

8. An exercise apparatus as claimed in claim 7, further comprising means for energizing said drive motor at intervals for altering the relative angular positions of said two body parts and, hence, the relative angle of inclination of said end members.

9. An exercise apparatus as claimed in claim 7, further comprising drive means for turning one of said body parts on its corresponding end bearing relative to its corresponding end member.

10. An exercise apparatus as claimed in claim 9, in which said drive means is arranged to change periodically the direction of rotation of said one body part relative to its corresponding end member.

11. An exercise apparatus as claimed in claim 7, in which said end bearings have their rotational axes offset from each other.

12. An exercise apparatus as claimed in claim 7, in which one said end member comprises a base for positioning horizontally and the other said end member forms a platform for a user to stand or sit upon.

* * * * *